US007096809B1

(12) United States Patent
Victor

(10) Patent No.: US 7,096,809 B1
(45) Date of Patent: Aug. 29, 2006

(54) WATERCRAFT DRY STORAGE AND STORAGE METHOD

(76) Inventor: Remi L. Victor, 845 Collier Ct., Unit 206, Marco, FL (US) 34145

( * ) Notice: Subject to any disclaimer, the term of this patent is extended or adjusted under 35 U.S.C. 154(b) by 0 days.

(21) Appl. No.: 10/913,115

(22) Filed: Aug. 6, 2004

Related U.S. Application Data

(60) Provisional application No. 60/492,891, filed on Aug. 6, 2003.

(51) Int. Cl.
*B63B 1/02* (2006.01)

(52) U.S. Cl. ..... 114/45; 114/49

(58) Field of Classification Search ..... 114/263, 114/44, 45, 49, 54, 222; 403/3
See application file for complete search history.

(56) References Cited

U.S. PATENT DOCUMENTS 1,116,835 A * 11/1914 Neumann ..... 114/54
1,293,899 A * 2/1919 Pendergast ..... 114/54
1,973,813 A 9/1934 Kelley
2,177,753 A * 10/1939 St. Pierre ..... 59/90
3,603,276 A * 9/1971 De Lisle ..... 114/45
4,282,822 A * 8/1981 Jackson ..... 114/222
4,782,778 A 11/1988 Barbaglia
5,065,464 A * 11/1991 Blanchard et al. ..... 5/81.1 R
5,341,756 A 8/1994 Hinze
5,394,814 A 3/1995 Rutter
5,713,817 A * 2/1998 Buchanan ..... 482/23
5,860,379 A * 1/1999 Moody ..... 114/54
6,006,687 A 12/1999 Hillman

* cited by examiner

*Primary Examiner*—Sherman Basinger
(74) *Attorney, Agent, or Firm*—Robert L. Farris

(57) ABSTRACT

The watercraft dry storage assembly includes a cylindrical port bladder and a cylindrical starboard bladder. Both bladders are made from sheet material with a substantially non-stretchable polyester or nylon scrim encased in a poly vinyl chloride plastic, a urethane plastic or a mixture of poly-vinyl chloride and urethane. The bladders are attached to each other. A blower system blows air into the bladders to lift a boat hull out of the water. The blower system also sucks air out of the bladders to lower the boat into the water. A guide system indicates the location of the bladders under the water and guides the bladders as they are inflated. One or more envelopes with open tops are attached to the bladders if required and receive rudders, keels and propellers as they are raised by the bladders. After the open tops are raised above the water, water in the envelopes are pumped out by a pump.

5 Claims, 8 Drawing Sheets

WATERCRAFT DRY STORAGE AND STORAGE METHOD

REFERENCE TO CO-PENDING APPLICATION

This application claims the benefit of U.S. Provisional Patent Application Ser. No. 60/492,891, filed on Aug. 6, 2003.

BACKGROUND OF THE INVENTION

1. Field of the Invention

A boat is protected from contaminants in water and water borne organisms during extended periods of non-use by inflatable bladders that lift the hull above the surface of the water, an envelope with an open top edge that encases the keel, rudder and/or propeller as required, an envelope holder that secures the open edge of the envelope above the surface of the water, and a pump that removes water from the envelope.

2. Related Art

Boats are usually taken out of the water during extended periods of non-use. Removal from the water is expensive for boats that are to large to be carried on a trailer pulled by a small truck or car. Removal as well as return to the water may have to be scheduled weeks or even months in advance. As a result a boat is often unavailable for use on days when the weather is excellent for boating.

Boats are often left in the water during periods of non-use of a few weeks. Contaminants in the water can stick to and stain surfaces of the boat hull and keel. Various water borne organisms can attach to the hull, grow for periods of time and damage the hull and keel surfaces.

Inflatable airbags have been used to lift the hull of boats above the surface of the water. These airbags have not however lifted the keel of a sailboat out of the water. The rudder and prop of motorboats may also remain in the water. Sailboats with a fixed keel would be unstable if the hull and the keel were both lifted above the water by airbags.

Flexible containers have been employed to receive the submerged surfaces of ocean going ships. These containers receive chemical that kill marine life attached to the ship hull. Pumps are provided to pump water and chemicals into and out of the container. Following the chemical treatment, the ship is returned to service. The system is for quick treatment to remove marine life from a ship hull. Damage to the hull has most likely occurred prior to chemical treatment. The pumps and chemical storage tanks are on a barge that has substantial size. Two small boats are used to pull one of the containers from the barge. Multiple motors are required to power pumps, wenches, screws and other portions of the system. Such systems are clearly designed to periodically treat the hulls of a number of ships each year.

BRIEF DESCRIPTION OF THE DRAWINGS

The presently preferred embodiments of the invention are disclosed in the following description and in the accompanying drawing, wherein.

DETAILED DESCRIPTION OF THE PREFERRED EMBODIMENTS

Figure 7:
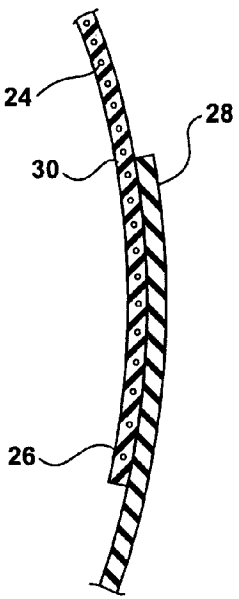
FIG. 7 is an enlarged sectional view taken along line 7—7 in FIG. 6.
Figure 6:
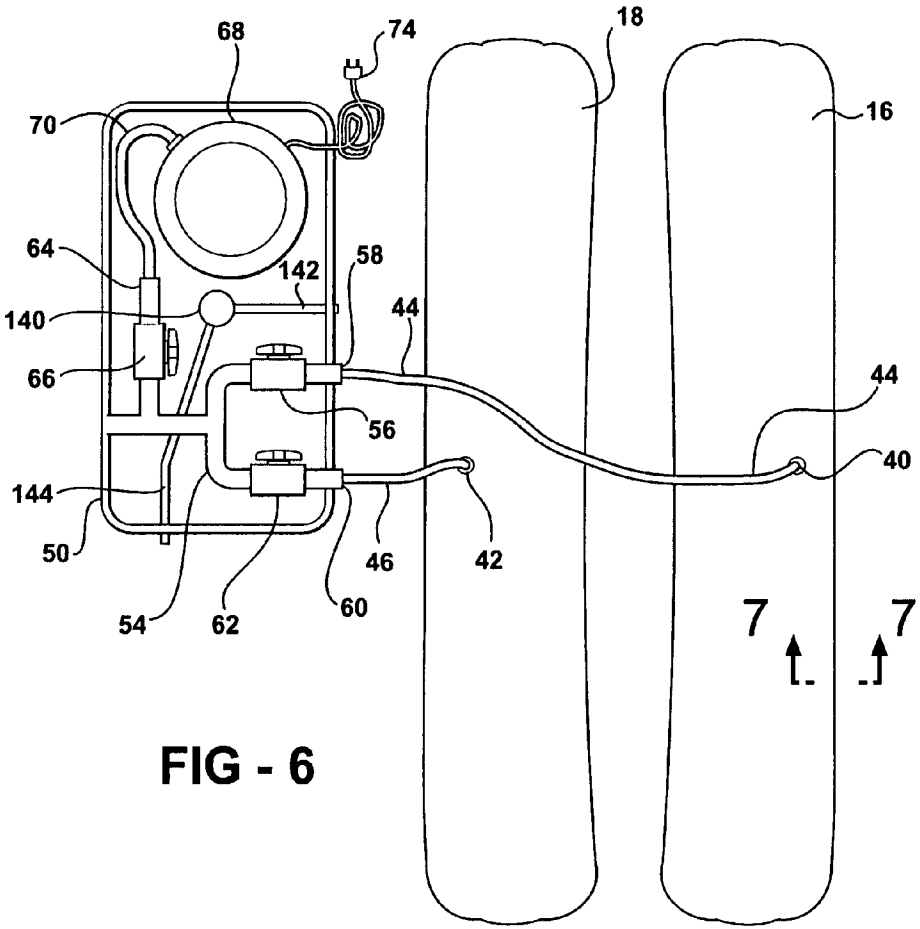
FIG. 6 is a schematic view of two bladders and the bladder inflation system.
Figure 8:
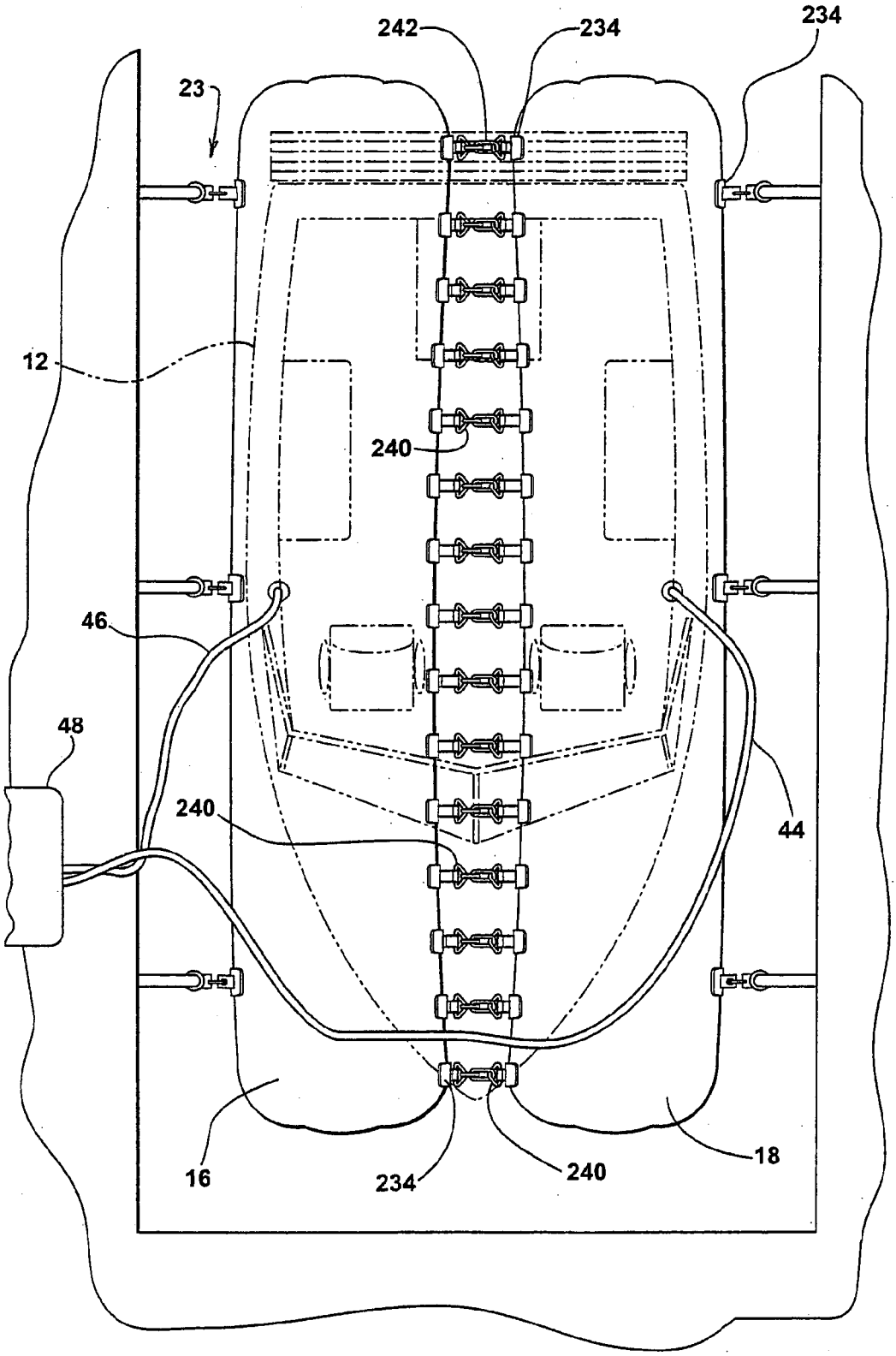
FIG. 8 is a top plan view showing a series of connector assemblies and chain links connecting two bladders together.
Figure 9:
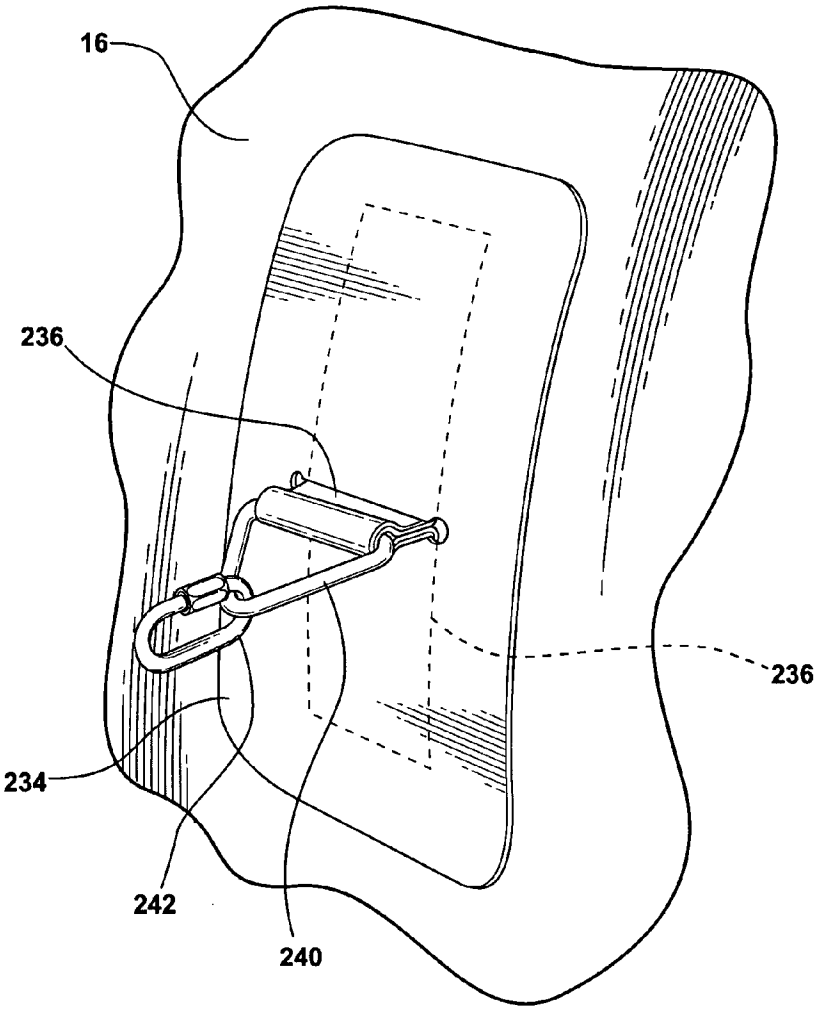
FIG. 9 is an enlarged perspective view of one connector assembly with a steel ring.

The dry storage assembly 10 for storing watercraft such as motorboats 12, sailboats 14, catamarans, and pontoon boats includes a pair of bladders 16 and 18, a blower system 20 for inflating and deflating the bladders, a retainer system 22 for attaching the bladders to each other, a locator system 23 for aligning the boat with the bladders, and a dry pouch for protecting boat parts that are not lifted from the water. The bladder 16 and 18 may be made from sheets of polyester scrim 24 that is substantially non-stretchable and encased in a flexible poly vinyl chloride plastic 30. Nylon scrim can be used in place of the polyester scrim. Nylon becomes substantially non-stretchable when loaded. The poly-vinyl chloride can be replaced or mixed with urethane. Other thermoplastics that remain flexible at temperatures of 32° Fahrenheit and somewhat lower and that can be bonded by heat can be employed. A seam binding strip (not shown) can be used to cover the exposed edge 28 and increase joint strength. The binding strip is bonded to the sheet material by heat. Seams in the material are made by over lapping two edges 26 and 28 of the material by about 2 inches, as shown in FIG. 7, and then heating the over lapping area with air from a blower having a heating coil. The air is heated by the coil to about 7000 to 1,000° Fahrenheit. The joint is cooled by ambient air while the over lapping edges 26 and 28 are held in engagement with each other. The bladders 16 and 18 have a diameter of about 42 inches. The length of each bladder 16 and 18, as shown, is about 20 feet. A load of about 24,600 pounds would be required to sink one such bladder. However, about 60 to 80% of each bladder 16 and 18 should remain above the water when supporting a boat. Larger boats will require larger bladders with an increased bladder volume. The bladders 16 and 18 can be lengthened to increase the volume. The diameter can also be increased or decreased to change the volume or to accommodate a boat with different features.

The non-stretchable polyester or nylon scrim 24 in the bladders 16 and 18 tends to form bladders that are nearly cylindrical when fully inflated. The cross section of the inflated bladders approaches circular. The length from one end to the other approaches a straight line. As a result the hull 32 of a boat 12 or 14 tends to set up on top of the bladders 16 and 18. The bladders 16 and 18 can be longer than the boat 12 or 14 or shorter. The polyester scrim 24 that is non-stretchable tends to hold ends of the bladder 16 and 18 in the water at nearly the same depth as the center portion of the bladders thereby supporting a substantial share of the total weight. Nylon scrim also holds the ends of the bladders in the water when loaded by air under pressure.

Grommets 34 are secured to reinforcement pieces 36, of the scrim 24 encased in flexible poly vinyl chloride or similar material that is used to form a bladder 16 or 18 and bonded to both bladders in selected positions along the length of the bladders. The bonding is preferably done by heat but can also be accomplished with an adhesive. A plurality of retainer lines 38 are connected to grommets 34 to limit separation of two bladders 16 and 18 and form the retainer system 22. These lines 38 are attached in locations in which they do not interfere with rudders, screw shafts or the keel. The lines 38 are lengthened or shortened as required to hold the bladders 16 and 18 in the desired position relative to the hull 32. The grommets 34 together with reinforcement pieces 36 and the retainer lines 38 form the retainer system 22. The lines 38 generally do not need to be released or tightened to raise a boat from the water or lower a boat into the water because the dry storage assembly 10 is moved vertically into or out of engagement with a boat 12 or 14.

The blower system 20 for inflating and deflating bladders 16 and 18 includes a pressure tube connector 40 attached to the bladder 16 and a tube connector 42 attached to the bladder 18. These tube connectors 40 and 42 are connected to the bladders 16 and 18 where they are protected and generally do not interfere with a boat moving into a position to be raised or moving away from the dry storage assembly 10.

A port bladder tube 44 is connected to the tube connector 40. A starboard bladder tube 46 is connected to the connector 42. Both tubes 44 and 46 are preferably relatively large diameter tubes to accommodate the low pressure air supply 48. Two inch diameter tubes 44 and 46 work satisfactorily. However, larger tubes 44 and 46 would most likely be somewhat faster. The tubes 44 and 46 should not be collapsible so that air can be pumped from the bladders 16 and 18. The connections of the tubes 44 and 46 to the connectors 40 and 42 as well as the connections to the air supply 48 are releasable with a suitable tool. However, it would be convenient in some cases if there were rapid couplers of some type between the tubes 44 and 46 and the air supply 48.

The air supply 48 includes a plastic box 50 with a removable cover 52. An air manifold 54 is mounted inside the box 50. The manifold 54 has one port 58 with a valve 56 connected to a bladder tube 44. Another port 60 with a valve 62 is connected to the bladder tube 46. The third port 64 with a valve 66 is connectable to a blower or vacuum cleaner 68 by an air tube 70. A standard vacuum cleaner 68 discharges sufficient air to inflate both bladders 16 and 18 in about ten minutes. A standard vacuum cleaner 68 also produces sufficient air pressure when the bladders 16 and 18 have sufficient size. The vacuum cleaner 68 can be operated by a 110 volt alternating current through a terminal 74 or it can be operated by direct current. The ideal vacuum cleaner 68 should be reversible so that air can be supplied to the manifold 54 or sucked from the manifold. If the vacuum cleaner 68 is not reversible it will be necessary to shift the air tube 70 from an air outlet on the cleaner to a suction side of the blower inside the vacuum cleaner. The vacuum cleaner 68 can also be replaced by a commercially available air blower. Valves 56 and 62 are opened and closed as required to keep a boat hull 32 at the same elevation on both sides during lifting of the hull as well as during lowering of the hull. When lifting the boat hull 32 air tends to flow to the bladder 16 or 18 with the lightest load. When lowering the hull 32 into the water, air tends to flow faster out of a bladder 16 or 18 with the heaviest load to support. Failure to keep a boat hull 32 at equal elevation on both sides when the bladders 16 and 18 are supporting a portion of the weight could cause a boat 12 or 14 to slip off the bladders.

Figure 5:
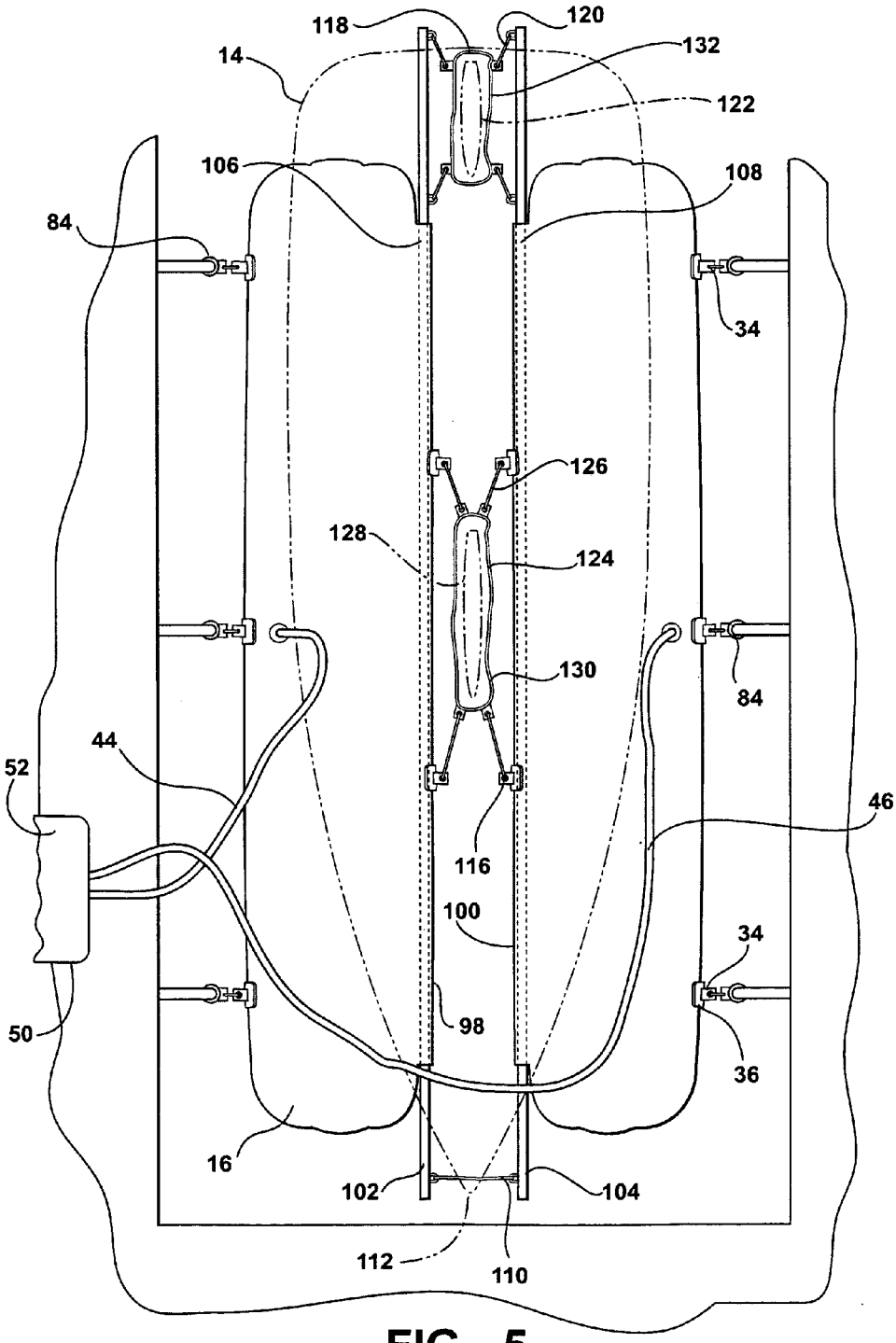
FIG. 5 is a top plan view of two bladders lifting a sailboat.

A boat 12 as well as the boat 14 are shown in the drawing Figures in a slip 76. The slip 76 is illustrated as a wharf 78 with vertical walls 80. Vertical guide bars 82 are attached to both sides of the slip 76. Sliders 84 are slideably mounted on the vertical guide bars 82. Grommets 34 on the outer sidewalls of the bladders 16 and 18 are attached to the sliders 84 by bladder positioning lines 86. As shown in FIG. 5, there are three vertical guide bars 82 on each side of the slip 76 with sliders 84. Each slider 84 is connected to a grommet 34 on one of the bladders 16 and 18. The number of sliders 84 that are attached to the bladders 16 and 18 can be changed as required. Weights 88 are attached to the sliders 84 as required by lines 90. The bladders 16 and 18 tend to float in the water. The weights 88 are provided to pull the dry storage assembly 10 free of a boat hull 32 as quickly as possible. The vacuum cleaner 68 has a suction side that is connected to the bladder 16 and 18 to remove the air quickly. Even with the weights 88 and the pump 68 to remove air from the bladders, it generally takes longer to deflate the bladders 16 and 18 and free boat 12 or 14 to move out of a slip 76 then it takes to lift a boat hull, out of the water.

In an off shore anchorage situation, rather than a slip 76, the dry storage assembly 10 can be employed. Weights on the bottom are employed to fix the position of the bladders 16 and 18. Buoys can be used to mark the location of the weights. The tubes 44 and 46 are disconnected from the manifold 54, plugged and tied to an anchor buoy. The blower system is carried by the boat 12 or 14 rather than being positioned on a wharf 78. The dry storage assembly 10 is then employed the same way it would be employed with a slip 76.

Motorboats 12 have rudders, propeller and propeller shafts that extend down into the water below the hull 32. With many boat designs the rudder, propeller shaft and propeller can be raised out of the water by the bladders 16 and 18. When the rudder or propeller cannot be raised out of the water, they can be inserted into an envelope 92 with an open top 94 like the keel 96 of the sailboat 14 as described above.

The bladder 16 and 18, as shown in FIG. 5, have sleeves 98 and 100 formed on their inside edges. These sleeves are formed by attaching a strip of sheet material 25 used to form the bladder 16 and 18 to the outside surface of the bladders and securing the strips of material 106 and 108 in placed by heating, as described above, or by an adhesive. A pipe 102 is inserted into the sleeve 98 formed by the strip of material 106. A pipe 104 is inserted into the sleeve 100 formed by the strip of material 108. The pipes 102 and 104 are longer than the bladders 16 and 18 and protrude from both ends of the sleeves 98 and 100. As shown in FIG. 5, a retainer line 110 limits separation of the pipes 102 and 104 at the bow 112 of the boat 14. Another line 110 can be attached to the pipes 102 and 104 at the stern 114 of the boat. Additional retainer lines 110 can be attached to grommet assemblies 116 attached to the strips of material 106 and 108. These grommet assemblies 116 are the same as the grommet 34 and reinforcement piece 36 described above. A rudder envelope 118 is attached to the pipes 102 and 104 by four lines 120 and receives a rudder 122. A keel envelope 124 is connected to grommet assemblies 116 by four lines 126 and receives a keel 128. The lines 120, 126 and 138 attaching envelopes also limit separation of the pipes 102 and 104. The top 130 of the keel envelope 124 and the top 132 of the rudder envelope 118 are raised above the water line 134 as the bladders 16 and 18 are inflated and the hull 32 of the boat 12 or 14 is raised out of the water. A series of attaching assemblies 234 with reinforcement pieces 236, with scrim 24 as shown in FIG. 7, and stainless steel triangular rings 240 can be attached to the sides of the bladders 16 and 18 in place of the sleeves 98 and 100. Stainless steel connector chain links 242 are used to connect assemblies 234 on one bladder 16 with the connector assemblies on the other bladder 18. Chain links 242 can be added to provide additional space between the bladders 16 and 18. Chain links 242 can be removed in areas in which space is required for a rudder or other boat assembly.

The envelopes 92, 118 and 124 are designed and constructed to fit the boat that the dry storage assembly 10 is to be used with. A single elongated envelope will fit some boats. More than four lines 126 are required for a single long envelope. Keel envelopes 92 or 124 as well as rudder envelopes 118 must be designed to fit the rudder 122 and the keel 128 they are to receive. They must also be attached to the bladder 16 and 18 in the proper location. If an envelope is to receive a propeller, the envelope must be able to receive the propeller and be positioned properly to do so.

Figure 1:
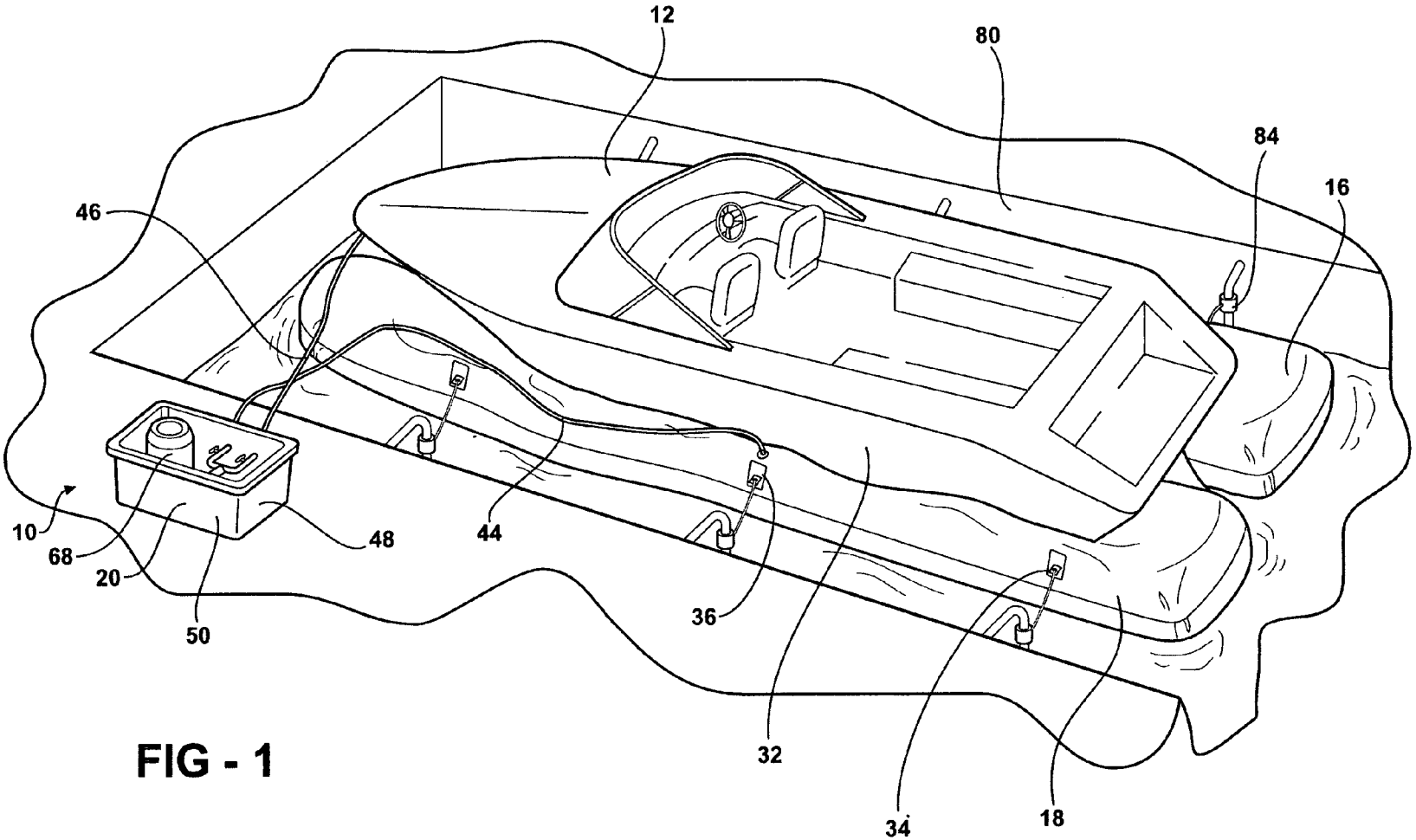
FIG. 1 is a perspective view of a boat in a boat slip and raised out of the water by two inflatable bladders.
Figure 2:
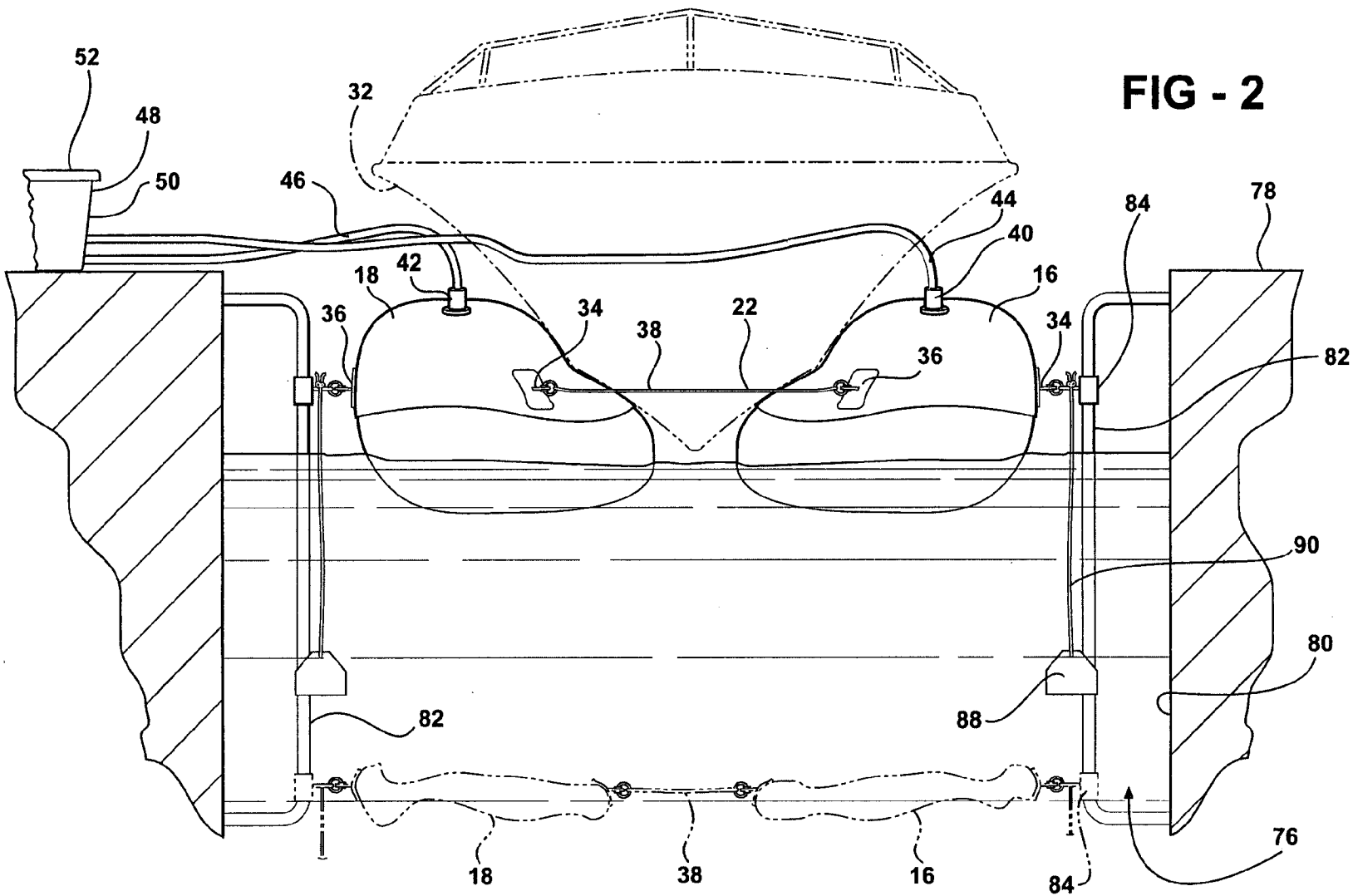
FIG. 2 is a front elevational view of the boat of FIG. 1 supported by the bladders and held out of the water.
Figure 3:
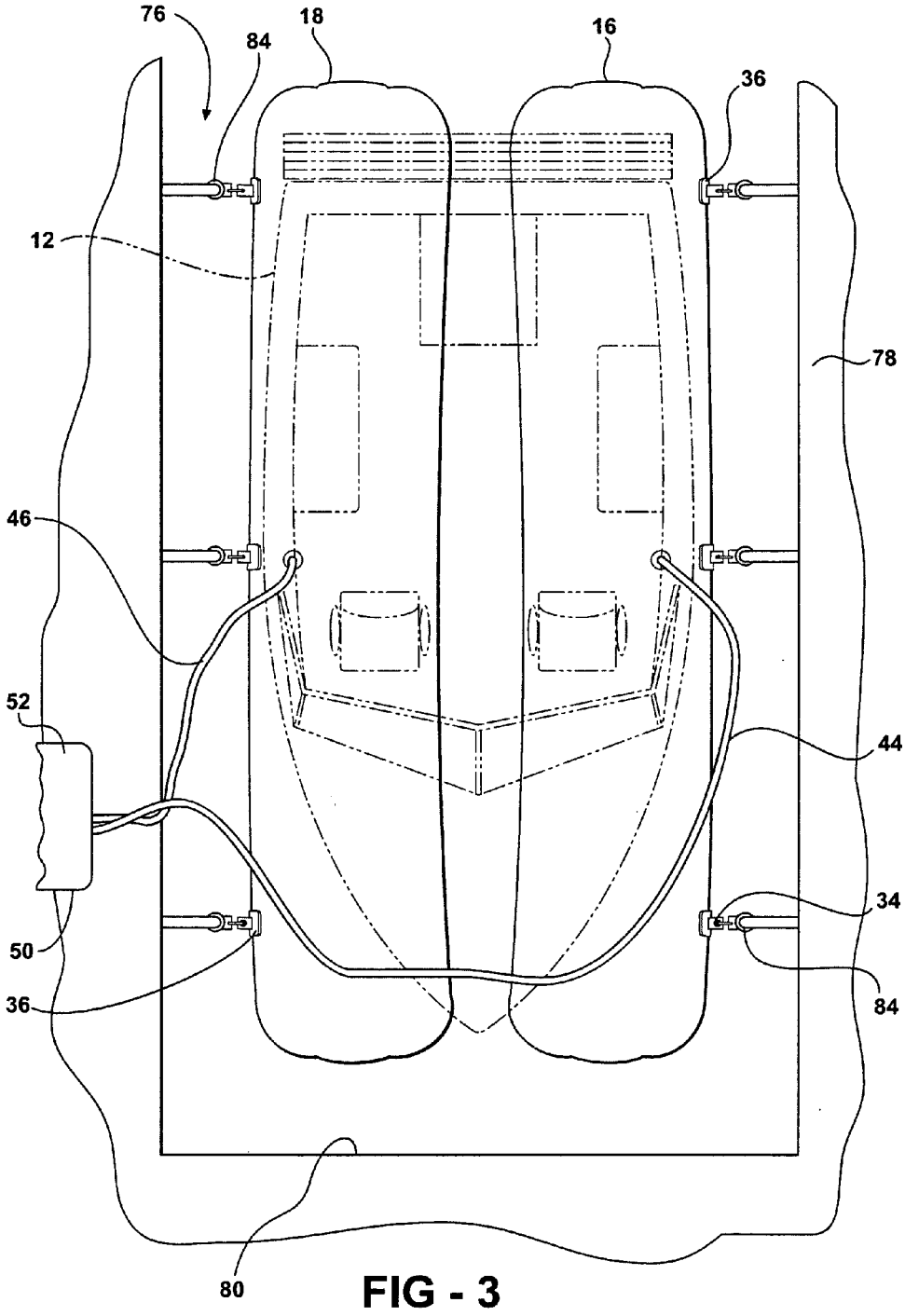
FIG. 3 is a top plan view of the boat of FIG. 1 lifted out of the water by two bladders.
Figure 4:
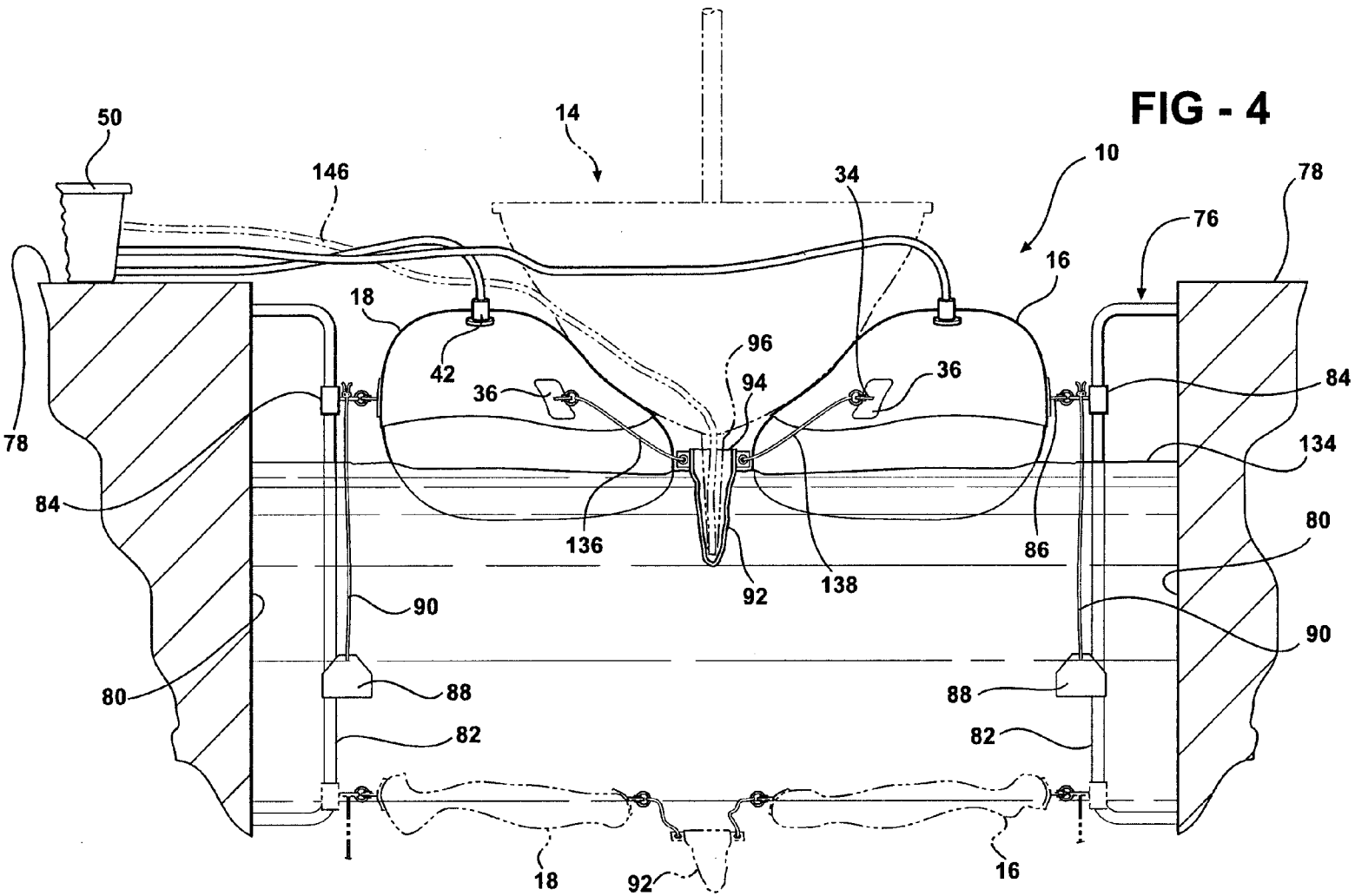
FIG. 4 is a front elevational view of a sailboat supported by two bladders and with a keel inside a dry container.

The envelope 92, shown in FIG. 4, is attached to grommet assemblies 34 and 36 attached directly to the bladders 16 and 18 by lines 136 and 138. The pipes 102 and 104 are not employed. Pipes 102 and 104 facilitate the connection of envelopes 118 and 124. However, the envelopes can in most cases be attached directly to the bladder 16 and 18.

The use of envelopes to encase keels, rudders, propellers and possibly other boat components requires the addition of a pump 140 to the box 50. The pump 140 has an inlet pipe 142 and a water discharge pipe 144. The inlet pipe 142 is connected to a line 146 shown in FIG. 4, that extends into the envelope 92. The pump 140 can be driven by an electric motor or it can be manually operated to remove water from the envelope 92. The end of the pipe 146 that extends into the envelope 92 should be secured in the envelope. When two or more envelopes 118 and 124 used, there should be a separate line 146 attached to each envelope to make sure all the water is removed from each envelope. Each line 146 is separately connected to the pump 140.

The employment of the dry storage assembly 10, as described above, relates to use with motorboats and sailboats. The assembly 10 will also work with catamarans and pontoon boats. However, this system for attaching the bladder 16 and 18 to such craft may require some modification to ensure that the hulls do not fall off the bladders 16 and 18. Increasing the length of retainer lines 38 will be sufficient for some such craft. Spreaders to hold the bladders apart may be required for other craft with two separate hull structures.

During employment of the dry storage assembly 10, two bladders 16 and 18 that are deflated are placed in a fixed position under the water a sufficient distance from a boat to be stored, to be passed over by a boat. Bladders 16 and 18 are attached to each other by retainer lines 32 with a desired length and in the appropriate locations for the boat to be stored. If the bladder 16 and 18 are in a boat slip 76, each bladder is position by two or more sliders 84 on vertical guide bars 82 and by bladder position lines 86. Weights 88 keep the bladder 16 and 18 from floating upward. Envelopes 92 are attached to the bladder 16 and 18 if required. A boat 12 or 14 to be lifted out of the water is then moved into the slip 76 and into a position directly above the bladder 16 and 18.

The vacuum cleaner 68 is turned on and valves 56, 60 and 66 are opened to supply air from the vacuum cleaner discharge to both bladders simultaneously. As the bladders 16 and 18 move into contact with the hull 32, a check is made to ensure that the bladders and the retainer line 38 are properly positioned relative to the boat hull. As air continues to be forced into the bladder 16 and 18, the rate of inflation is maintained to ensure that both bladders are filled at the same rate. The valve 56 or 62 is closed as required to slow the rate at which one of the bladders expands until the other bladder catches up and both sides of the boat are at the same elevation. The closed valve is then opened so that both bladders will fill as rapidly as possible. Water is pumped from any envelopes 92, 118 or 124 as soon as the upper edges 94, 130 or 132 are above the water surface 134, by energizing the pump 140. Upon both bladders being completely filled, the valve 66 is closed and the vacuum cleaner 68 is turned off. The time to fill two bladders 16 and 18 that are 20 feet long and 42 inches in diameter should be about 10 to 12 minutes depending upon the capacity of the vacuum cleaner 68 and the size of the port bladder tube 44 and the starboard bladder tube 46. The valves 56 and 62 are generally left open so that a leak will allow both bladders 16 and 18 to collapse together. The pump 140 is turned off as soon as the envelopes 92, 118 or 124 that are used have been drained.

To lower a boat 12 or 14 from dry storage into the water, the valves 56, 62 66 are open, and the vacuum cleaner 68 is reversed and energized to suck air from the bladders 16 and 18. The rate of deflation is monitored to ensure that both bladders deflate at that the same rate. If one side of the boat is closer to the water than the other side, the valve 56 or 62 for the bladder supporting the low side is closed. Upon both sides of the boat obtaining the same elevation, the closed valve 56 or 62 is opened again.

After the bladder 16 and 18 are fully deflated, the vacuum cleaner 68 is turned off and the valves 56 and 62 are closed. A check is made to ensure the bladders 16 and 18 and any envelopes 92, 118 and 124 and any retainer lines 38 are clear of the boat 12. The boat is then free to move from the slip. The procedure for a boat 12 or 14 in open water is substantially the same as procedure set forth above with a few exceptions. A mooring block and buoy are set. Bladder guide blocks are placed at the port bladder 18 outside edge and at the front end and the rear end of the port bladder 18. Bladder guide blocks are also placed at the starboard bladder 16 outside edge and at the front end and the rear end of the starboard bladder. Guide ropes and guide block buoys are secured to each bladder guide block. A slider 84 on each guide rope is attached to an adjacent bladder. A weight is attached to the bladder and to each slider to hold deflated bladders in place. A boat is then placed between the four guide block buoys and moored to the mooring block. The bladder tubes 44 and 46 are retrieve from the mooring buoy, unplugged and attached to the air manifold 54 in the box 50. The bladder 16 and 18 are then inflated as explained above. Once the boat is raised out of the water, the valve 56 is closed and the vacuum cleaner 68 is turned off. The bladder 16 and 18 may or may not remain attached to the slider on the guide ropes attached to the guide block buoys. The boat is returned to the water the same way as the boat in a slip is returned to the water. The blower 68 and the valve 66 as described above are manually operated. When a watercraft 12 or 14 is being placed into dry storage or returned to the water there is a person available to monitor the operation. If the blower 68 runs too long, it would not be a problem because the maximum pressure generated by the blower is relatively low and is far below the pressure that would cause the bladders 16 and 18 to fail. However, the valve 66 and the blower 68 can be controlled by a control system that energized the blower 68 and opens the valve 66 anytime the air pressure in the bladders falls below a selected low pressure. The control system would also turn the blower 68 off and close the valve 66 when the air pressure exceed a selected high pressure. An alternate version of the control system could turn the blower 68 off and close the valve 66 after a selected time interval. The automatic system increases the time intervals between periodic checks of the status of the bladders 16 and 18 and a watercraft supported by the bladders.

I claim:

1. A watercraft dry storage assembly comprising:

a port bladder made from a sheet material with a polyester scrim enclosed in a poly vinyl chloride plastic and formed into a generally cylindrical impervious container;

a starboard bladder made from a sheet material with a polyester scrim encased in a poly vinyl chloride plastic and formed into a generally cylindrical air impervious container;

at least two retainer lines, each of which is connected to the port bladder and to the starboard bladder to limit separation of the port bladder from the starboard bladder;

a blower system including a blower connected to a manifold, a port bladder tube connected to the port bladder and to the manifold, a starboard bladder tube connected to the starboard bladder and to the manifold, a first valve controlling the flow of air between the manifold and the port bladder;

a second valve controlling the flow of air between the manifold and the starboard bladder;

a rudder envelope, with an open top, attached to the port bladder and the starboard bladder; and a pump attached to the rudder envelope by a tube and operable to pump water from the rudder envelope.

2. A watercraft dry storage assembly comprising:

a port bladder made from a sheet material with a polyester scrim enclosed in a poly vinyl chloride plastic and formed into a generally cylindrical impervious container;

a starboard bladder made from a sheet material with a polyester scrim encased in a poly vinyl chloride plastic and formed into a generally cylindrical air impervious container;

at least two retainer lines, each of which is connected to the port bladder and to the starboard bladder to limit separation of the port bladder from the starboard bladder;

a blower system including a blower connected to a manifold, a port bladder tube connected to the port bladder and to the manifold, a starboard bladder tube connected to the starboard bladder and to the manifold, a first valve controlling the flow of air between the manifold and the port bladder;

a second valve controlling the flow of air between the manifold and the starboard bladder;

a keel envelope, with an open top, attached to the port bladder and to the starboard bladder; and a pump attached to the keel envelope by a tube and operable to pump water from the keel envelope.

3. A watercraft dry storage assembly comprising:

a port bladder made from a sheet material with a polyester scrim enclosed in a poly vinyl chloride plastic and formed into a generally cylindrical impervious container;

a starboard bladder made from a sheet material with a polyester scrim encased in a poly vinyl chloride plastic and formed into a generally cylindrical air impervious container;

at least two retainer lines, each of which is connected to the port bladder and to the starboard bladder to limit separation of the port bladder from the starboard bladder;

a blower system including a blower connected to a manifold, a port bladder tube connected to the port bladder and to the manifold, a starboard bladder tube connected to the starboard bladder and to the manifold, a first valve controlling the flow of air between the manifold and the port bladder;

a second valve controlling the flow of air between the manifold and the starboard bladder;

a keel and rudder envelope with an open top, attached to the port bladder and the starboard bladder; and a pump attached to the keel and rudder envelope by a tube and operable to pump water from the keel and rudder envelope.

4. A watercraft dry storage assembly comprising:

a port bladder made from a sheet material with a polyester scrim enclosed in a poly vinyl chloride plastic and formed into a generally cylindrical impervious container;

a starboard bladder made from a sheet material with a polyester scrim encased in a poly vinyl chloride plastic and formed into a generally cylindrical air impervious container;

at least two retainer lines, each of which is connected to the port bladder and to the starboard bladder to limit separation of the port bladder from the starboard bladder;

a blower system including a blower connected to a manifold, a port bladder tube connected to the port bladder and to the manifold, a starboard bladder tube connected to the starboard bladder and to the manifold, a first valve controlling the flow of air between the manifold and the port bladder:

a second valve controlling the flow of air between the manifold and the starboard bladder; and wherein the two retainer lines are connected to a first pipe that extends through a port sleeve secured to the port bladder and a second pipe extending through a starboard sleeve secured to the starboard bladder.

5. A watercraft dry storage assembly, as set forth in claim 4, wherein the first pipe is longer than the port bladder and the second pipe is longer than the starboard bladder.

* * * * *